US012234816B2

(12) United States Patent
Rutar et al.

(10) Patent No.: US 12,234,816 B2
(45) Date of Patent: Feb. 25, 2025

(54) VARIABLE DISPLACEMENT PUMPS

(71) Applicant: Hamilton Sundstrand Corporation, Charlotte, NC (US)

(72) Inventors: Matej Rutar, Manchester, CT (US); Morgan O'Rorke, West Hartford, CT (US); Ryan Shook, Rockford, IL (US); Ryan Susca, Windsor, CT (US)

(73) Assignees: Hamilton Sundstrand Corporation, Charlotte, NC (US); HAMILTON SUNDSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 17/508,058

(22) Filed: Oct. 22, 2021

(65) Prior Publication Data

US 2023/0130997 A1 Apr. 27, 2023

(51) Int. Cl.

| | |
|---|---|
| ***F04B 49/12*** | (2006.01) |
| ***F04B 49/00*** | (2006.01) |
| ***F04B 49/24*** | (2006.01) |

(52) U.S. Cl.

CPC ..... *F04B 49/12* (2013.01); *F04B 49/002* (2013.01); *F04B 49/24* (2013.01)

(58) Field of Classification Search

CPC ..... F04C 28/22; F04C 28/18; F04C 28/00; F04B 1/06; F04B 1/07; F04B 1/26; F04B 1/1295; F04B 1/324; F04B 1/328; F04B 1/34; F04B 49/12; F04B 49/123; F04B 49/125

See application file for complete search history.

(56) References Cited

U.S. PATENT DOCUMENTS

| | | | | |
|---|---|---|---|---|
| 3,733,963 | A | 5/1973 | Kubilos | |
| 4,420,935 | A * | 12/1983 | Kobald | F16H 61/42 60/427 |
| 4,480,438 | A * | 11/1984 | Breeden | F16H 61/439 60/389 |
| 5,065,577 | A | 11/1991 | Markunas | |
| 6,102,001 | A | 8/2000 | McLevige | |
| 6,684,636 | B2 | 2/2004 | Smith | |
| 7,966,995 | B2 | 6/2011 | Futa, Jr. et al. | |
| 8,584,441 | B2 | 11/2013 | Benson | |

(Continued)

FOREIGN PATENT DOCUMENTS

DE 2456381 A1 6/1976

OTHER PUBLICATIONS

Extended European Search Report dated Feb. 8, 2023, issued during the prosecution of European Patent Application No. EP 22203250.0.

(Continued)

*Primary Examiner* — Thomas Fink

(74) *Attorney, Agent, or Firm* — Kinney & Lange, P.A.

(57) ABSTRACT

In accordance with at least one aspect of this disclosure, a variable displacement pump system can include, a variable displacement pump disposed in a main line and configured to supply pressure to receive a low pressure fluid and to output a high pressure fluid. The main line can connect a hydraulic fluid source to a plurality of system actuators, where the variable displacement pump is disposed in the main line between the hydraulic fluid source and the plurality of system actuators to pressurize the hydraulic fluid.

4 Claims, 2 Drawing Sheets

(56) References Cited

U.S. PATENT DOCUMENTS

| | | | | |
|---|---|---|---|---|
| 2005/0100447 | A1 | 5/2005 | Desai et al. | |
| 2007/0119163 | A1* | 5/2007 | Tatsuno | F16H 61/4148 60/493 |
| 2015/0285214 | A1* | 10/2015 | Thoms | F16H 61/475 91/422 |
| 2018/0340501 | A1 | 11/2018 | Ni et al. | |
| 2020/0256326 | A1* | 8/2020 | Kharpas | F04B 1/324 |

OTHER PUBLICATIONS

Communication pursuant to Article 94(3) EPC dated Oct. 16, 2024, received for corresponding European Patent Application No. 22203250.0, 7 pgs.

* cited by examiner

VARIABLE DISPLACEMENT PUMPS

STATEMENT OF GOVERNMENT RIGHTS

This invention was made with government support. The government has certain rights in the invention.

TECHNICAL FIELD

The present disclosure relates to variable displacement pumps, and more particularly to methods for controlling variable displacement pumps.

BACKGROUND

Fixed displacement pumps can typically be sized to meet peak demand at a few operating conditions, meaning the pump is then oversized for the remainder of conditions. Variable displacement pumps can be used to provide greater efficiency, as the flow can be changed for each operating condition. However, the pump displacement must be controlled to ensure system responsiveness and stability standards are met.

There is always a need in the art for improvements to methods for controlling variable displacement pumps in the aerospace industry. This disclosure provides a solution for this need.

SUMMARY

In accordance with at least one aspect of this disclosure, a variable displacement pump system can include a variable displacement pump disposed in a main line and configured to receive a low pressure fluid and to output a high pressure fluid. A pressure port is disposed in the main line downstream of the variable displacement pump and is configured to port a portion of the high pressure fluid from the main line to a bias pressure line. A controllable valve is disposed in the bias pressure line configured to meter a pressure of the bias pressure line. In embodiments, the main line can be configured to supply hydraulic fluid from a hydraulic fluid source to a plurality of actuators.

A pressure actuated main piston is disposed in the bias pressure line upstream of the controllable valve and is configured to control displacement of a variable displacement pump at a predetermined pressure set point. A biasing member is operatively connected to the pressure actuated main piston and is configured to bias the main piston to a position to achieve a pressure output for the predetermined pressure set point. A pressure actuated biasing piston is operatively connected to the biasing spring can is configured to bias the pressure actuated main piston.

In embodiments, a controller can be operatively connected to control a pressure of the bias pressure line to control displacement of the variable displacement pump based at least in part on the predetermined pressure set point. In embodiments, the controller can be configured to control the controllable valve to adjust a position of the controllable valve to move the biasing piston to adjust the predetermined pressure set point. In embodiments, the controller can be configured to control the controllable valve to adjust the predetermined pressure set point in real time to control displacement of the variable displacement pump based on the predetermined pressure set point without stopping flow through the variable displacement pump. In certain embodiments, the controllable valve can include an electrohydraulic servo valve.

In certain embodiments, the system can include a bias assist valve disposed in the bias pressure line downstream of the controllable valve and upstream of the biasing piston and can be configured to meter a pressure in the bias pressure line acting on the biasing piston. In certain such embodiments, the controller can be configured to control the controllable valve to adjust the position of the controllable valve to control a pressure upstream of the bias assist valve to move the biasing piston to adjust the predetermined pressure set point.

In embodiments, the controller can be configured to control the controllable valve to adjust the predetermined pressure set point in real time to control displacement of the variable displacement pump based on the predetermined set point without stopping flow through the variable displacement pump. In embodiments, a fixed metering orifice can be disposed in the bias pressure line downstream of the controllable valve and can be configured to bleed a portion of the bias pressure fluid in the bias pressure line back to the main line, bypassing the bias assist valve. In certain embodiments, the controllable valve can include an electrohydraulic servo valve. In certain embodiments, the controllable valve can include a proportional solenoid.

In accordance with at least one aspect of this disclosure, a control system for a variable displacement pump, can include one or more sensors operatively connected to sense a position of one or more of a mechanical linkage operatively connected to a variable displacement pump, a pressure actuated main piston in a bias pressure line, and/or a pressure actuated bias piston operatively connected to the pressure actuated main piston via a biasing member. A controller can be operatively connected to receive one or more signals indicative of the position of one or more of the mechanical linkage of the variable displacement pump, the pressure actuated main piston in a bias pressure line, and/or the pressure actuated bias piston and configured to control a controllable valve disposed in the bias pressure line to control displacement of the variable displacement pump based at least in part the indicative signals. In embodiments, the controller can be configured to control the controllable valve to adjust a predetermined pressure set point in real time to control displacement of the variable displacement pump based on the predetermined set point without stopping flow through the variable displacement pump.

In accordance with at least one aspect of this disclosure, a method for controlling a variable displacement pump can include, porting a portion of a high pressure fluid from a main line to a bias pressure line, metering the high pressure fluid in the bias pressure line with a controllable valve to control a bias pressure supplied to a bias piston, and adjusting a position of the bias piston to control a predetermined pressure set point for a variable displacement pump disposed in the main line to change a displacement of the variable displacement pump.

In embodiments, the method can include metering the high pressure fluid in the bias pressure line with a bias assist valve disposed in the bias pressure line downstream of the controllable valve to control the bias pressure supplied to the bias piston. The method can further include, bleeding a portion of the bias pressure fluid and returning the portion of the bias pressure fluid to the main line, bypassing the bias assist valve. In embodiments, the method can further include, adjusting the position of the bias piston to control a predetermined pressure set point for the variable displacement pump, includes adjusting the position of the bias piston in real time to control displacement of the variable displacement pump based on the predetermined set point without stopping flow through the variable displacement pump.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
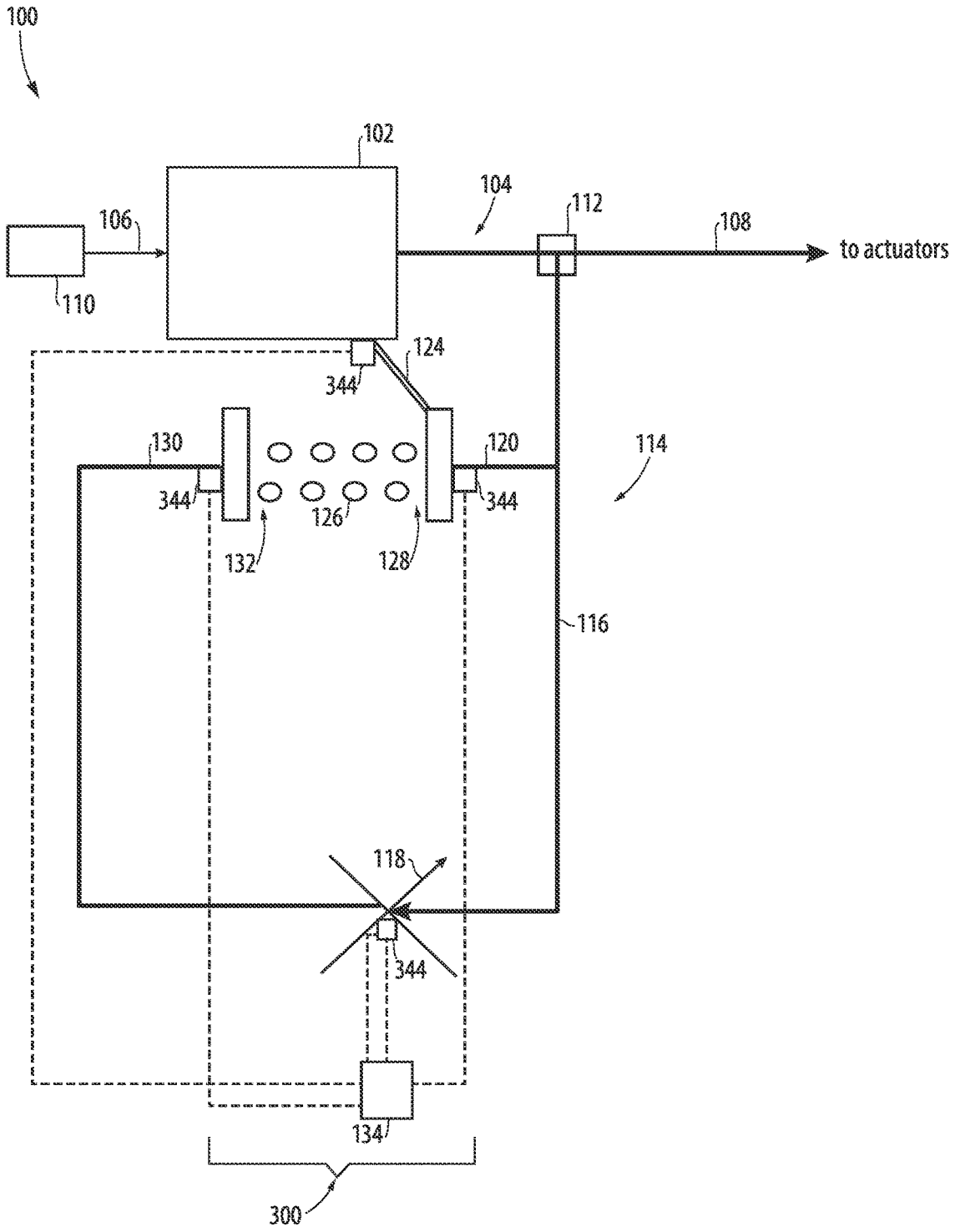
FIG. 1 is schematic view of a variable displacement pump system in accordance with this disclosure, showing a control scheme for controlling an output pressure of the variable displacement pump.
Figure 2:
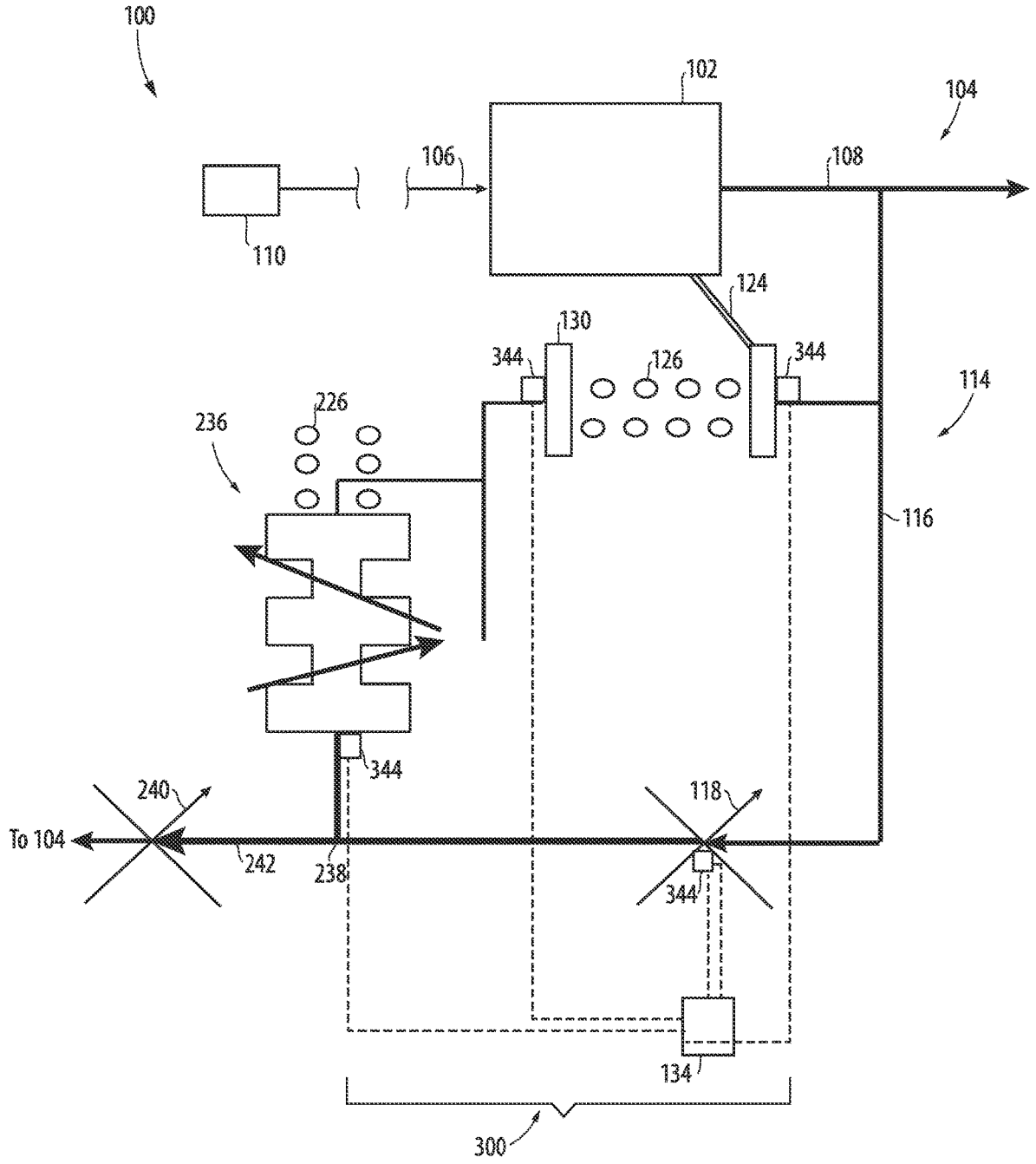
FIG. 2 is a schematic view of a variable displacement pump system in accordance with this disclosure, showing another control scheme for controlling an output pressure of the variable displacement pump.

Reference will now be made to the drawings wherein like reference numerals identify similar structural features or aspects of the subject disclosure. For purposes of explanation and illustration, and not limitation, an illustrative view of an embodiment of a system in accordance with the disclosure is shown in FIG. 1 and is designated generally by reference character 100. Other embodiments and/or aspects of this disclosure are shown in FIG. 2.

Fixed displacement pumps may be oversized to meet needs at certain operating conditions but then produce excess output during other operation. Variable displacement pumps can improve efficiency but require a control scheme. Traditional pressure compensated variable displacement pumps operate under at a single pressure set point or used a manual pressure adjustment mechanism. Embodiments described herein allow for the ability to adjust the output pressure set point for given system actuation needs.

In accordance with at least one aspect of this disclosure, a variable displacement pump system 100 can include, a variable displacement pump 102 disposed in a main line 104 and configured to receive a low pressure fluid from an inlet portion 106 of the main line 104 and to output a high pressure fluid to an outlet portion 108 of the main line 104. The main line 104 can connect a hydraulic fluid source 110 to a plurality of system actuators, where the variable displacement pump 102 is disposed in the main line 104 between the hydraulic fluid source 110 and the plurality of system actuators to pressurize the hydraulic fluid.

A pressure port 112 can be disposed in the main line 104 downstream of the variable displacement pump 102 configured to port a portion of the high pressure fluid 108 from the main line 104 to a bias pressure line 114. The port can be any suitable port, passive or active port that provides a path for a predetermined amount of hydraulic fluid to bypass the system actuators and enter the bias pressure line 114 as bias pressure fluid 116.

Within the bias pressure line 114, a controllable valve 118 can be disposed downstream of the pressure port 112 configured to meter the bias pressure fluid 116. In embodiments, the controllable valve 118 can be or include any suitable controllable valve or metering device (e.g. an electrohydraulic servo valve). A pressure actuated main piston 120 can be disposed in the bias pressure line 114 upstream of the controllable valve 118 operatively connected to a mechanical linkage 124. The mechanical linkage 124 can include a lever arm, for example, configured to change the displacement of the variable displacement pump 102 via movement of the piston 120. Movement of piston 120 through linkages 124 can therefore control the displacement of the pump 102 to provide a desired pressure output of the variable displacement pump 102 at a predetermined pressure set point. The predetermined set point can be any suitable amount known, or decided, based on a needed or desired pressure in the main line 104 for actuating the downstream system actuators.

A biasing member 126 (e.g. a spring or other resilient mechanical component) can be operatively connected to the pressure actuated main piston 120 at a first end 128 of the biasing member 126 and can be configured to bias the main piston 120 to a position to achieve the desired predetermined set point pressure for the variable displacement pump 102, wherein the position of the main piston 120 corresponds (or represents) the predetermined pressure set point. A pressure actuated biasing piston 130 can be operatively connected to a second end 132 of the biasing member 126 (e.g. opposite the first end 128 to provide a counter acting pressure to the pressure actuated main piston 120). The pressure actuated biasing piston 130 can be disposed in the bias pressure line 114 downstream of the controllable valve 118, wherein the output from the controllable valve 118 is a bias pressure that moves the pressure actuated biasing piston 130 to a desired position. Changing the position of the biasing piston 130 thus changes the pre-loaded spring force acting on the main piston 120, changing the position of the main piston 120. By adjusting the position of the main piston 120, the mechanical linkage 124 can then adjust the output of the variable displacement pump 102. Thus, it is therefore possible to adjust the pressure set point for the variable displacement pump 102 in real time. This allows for a pressure compensated proportional control where a drop in output pressure would cause the pump displacement to increase until output pressure rises again.

A controller 134 can be operatively connected (e.g. to the controllable valve 118) to control the pressure of the bias pressure line 114, for example by controlling the controllable valve 118. Controlling the controllable valve 118, therefore, controls pressure output of the variable displacement pump 102 based at least in part on the predetermined set point as determined by the main piston 120. For example, controlling a position, or opening of a metering orifice, of the controllable valve 118 will move the biasing piston 130 in a desired manner to adjust the predetermined set point as determined by the position of the main piston 120. Controlling the controllable valve 118, and adjusting the predetermined set point pressure in this manner allows for real time to control of displacement of the variable displacement pump 102 based on a variable set point, without stopping flow through the variable displacement pump 102.

In certain embodiments, as shown in FIG. 2, a system 200 can have similar components as in system 100. For brevity, the description of common elements that have been described above are not repeated with respect to FIG. 2. In system 200, a bias assist valve 236 can be disposed in the bias pressure line 114 downstream of the controllable valve 118 and upstream of the biasing piston 130, configured to meter pressure in the bias pressure line acting on the biasing piston 130, via a second resilient biasing member 226. In this case, the controller 134 can be configured to control the controllable valve 118 to meter the bias pressure fluid 116 upstream of the bias assist valve only so that modifying the bias pressure at a modification point 238 in the bias pressure line 114 between the bias assist valve 236 and the controllable valve 118 will be effective to change a predetermined pressure set point of the bias assist valve 236. The effect of the pressure on the bias piston 130 will be amplified with the inclusion of the bias assist valve 236. By acting as a hydraulic amplifier, the bias assist valve 236 allows the bias piston 130 to move quickly, for example when fast response is needed if the system experiences disturbance. This also allows for rapid changes to the predetermined system output pressure set point. Because of this, a smaller controllable valve 118 can be used in system 200 to change the set point of the variable displacement pump 102, than may be used in system 100.

In system 200, the controllable valve 118 can be or include at least one of an electrohydraulic servo valve, and/or a proportional solenoid valve. In certain embodiments, a fixed metering orifice 240 can be disposed in the bias pressure line 114 downstream of the controllable valve 118 and downstream of the modification point 238. The fixed metering orifice 240 can be configured to bleed a portion 242 of the bias pressure fluid 116 from the bias pressure line 114 back to the main line 104, bypassing the bias assist valve 236 and returning either to the main line 104 directly, or the hydraulic fluid source 110.

With reference to FIGS. 1 and 2, in accordance with at least one aspect of this disclosure, a control system 300 for the variable displacement pump 102 can include the features described herein above, and additionally or alternatively, one or more sensors 344 operatively connected to sense a position of one or more of the mechanical linkage 124 operatively connected to the variable displacement pump 102, the pressure actuated main piston 120, and/or the pressure actuated bias piston 130. In certain embodiments, a sensor 344 can be operatively connected to sense a position or orifice opening of the controllable valve 118 and/or the bias assist valve 236. Herein, the controller 134 can be operatively connected to receive one or more signals indicative of the position of one or more of the mechanical linkage 124, the pressure actuated main piston 120, and/or the pressure actuated bias piston 130 and configured to control the controllable valve 118 based at least in part the indicative signals.

In embodiments, the controller 134 and/or control system 300 can be or include both hard wired circuits that cause a logic (e.g. predictive) to be executed, and/or software-based components, for example, simple electric circuits employing analogue components, or the controller can include a CPU, a memory, machine readable instructions in the memory that when executed cause the CPU to perform a method or cause the control system to perform a method, for example as described below. In embodiments, the controller can utilize any suitable algorithm to control the controllable valve as provided herein. In embodiments, the algorithm could be constructed using the functionality as described above in addition to known general engineering principles as applied to the specific characteristics of each particular fuel system to which the technology of the present disclosure is applied.

In accordance with at least one aspect of this disclosure, a method for controlling a variable displacement pump 102 can include, porting a portion of a high pressure fluid 108 from a main line 104 to a bias pressure line 114, metering the high pressure fluid 116 in the bias pressure line 114 with a controllable valve 118 to control a bias pressure supplied to a bias piston 130, and adjusting a position of the bias piston 130 to control a predetermined pressure set point for the variable displacement pump 102 disposed in the main line 104 to change a pressure output of the variable displacement pump 102.

In embodiments, the method can further include metering the high pressure fluid 116 in the bias pressure line 114 with a bias assist valve 236 disposed in the bias pressure line 114 downstream of the controllable valve 118 to control the bias pressure supplied to the bias piston 130. The method can further include bleeding a portion 242 of the bias pressure fluid 116 to bypass the bias assist valve 136 and returning the portion 242 of the bias pressure fluid 116 to the main line 104.

In certain embodiments, adjusting the position of the bias piston 130 to control a predetermined pressure set point for the variable displacement pump 102 can include adjusting the position of the bias piston 130 in real time to control a pressure output of the variable displacement pump 102 based on the predetermined set point without stopping flow through the variable displacement pump 102.

As will be appreciated by those skilled in the art, aspects of the present disclosure may be embodied as a system, method or computer program product. Accordingly, aspects of this disclosure may take the form of an entirely hardware embodiment, an entirely software embodiment (including firmware, resident software, micro-code, etc.), or an embodiment combining software and hardware aspects, all possibilities of which can be referred to herein as a "circuit," "module," or "system." A "circuit," "module," or "system" can include one or more portions of one or more separate physical hardware and/or software components that can together perform the disclosed function of the "circuit," "module," or "system", or a "circuit," "module," or "system" can be a single self-contained unit (e.g., of hardware and/or software). Furthermore, aspects of this disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of this disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of this disclosure may be described above with reference to flowchart illustrations and/or block diagrams of methods, apparatus (systems) and computer program products according to embodiments of this disclosure. It will be understood that each block of any flowchart illustrations and/or block diagrams, and combinations of blocks in any flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in any flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified herein.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the apparatus and methods of the subject disclosure have been shown and described, those skilled in the art will readily appreciate that changes and/or modifications may be made thereto without departing from the scope of the subject disclosure.

What is claimed is:

1. A system, comprising:

a variable displacement pump disposed in a main line and configured to receive a low pressure fluid and to output a high pressure fluid;

a pressure port disposed in the main line downstream of the variable displacement pump configured to port a portion of the high pressure fluid from the main line to a bias pressure line;

a controllable valve disposed in the bias pressure line configured to meter a pressure of the bias pressure line;

a pressure actuated main piston disposed in the bias pressure line upstream of the controllable valve relative to the output of the variable displacement pump, and wherein the pressure actuated main piston is connected directly to the variable displacement pump by a mechanical linkage and configured to control displacement of the variable displacement pump at a predetermined pressure set point;

a biasing member operatively connected to the pressure actuated main piston and configured to bias the main piston to a position to achieve a pressure output for the predetermined pressure set point; and a pressure actuated biasing piston operatively connected to the biasing member and configured to bias the pressure actuated main piston, wherein the biasing piston is in the bias pressure line downstream of the controllable valve, wherein the output from the controllable valve is a bias pressure that moves the pressure actuating biasing piston to a desired position to change a preloaded spring force of the biasing member acting on the main piston.

2. The system as recited in claim 1, wherein the controllable valve includes an electrohydraulic servo valve.

3. The system as recited in claim 1, further comprising:

an electronic controller configured to control the controllable valve;

a first sensor in communication with the electronic controller and configured to sense a position of the pressure actuated main piston; and a second sensor in communication with the electronic controller and configured to sense a position of the pressure actuated biasing piston.

4. The system as recited in claim 3, further comprising:

a third sensor in communication with the electronic controller and configured to sense a position of the mechanical linkage; and a fourth sensor in communication with the electronic controller and configured to sense a position of the controllable valve.

* * * * *